United States Patent [19]

Defibaugh

[11] Patent Number: 4,537,392

[45] Date of Patent: Aug. 27, 1985

[54] FOLDABLE SWING SET

[75] Inventor: William L. Defibaugh, Bedford, Mass.

[73] Assignee: Brown Group Recreational Products, Inc., Bedford, Pa.

[21] Appl. No.: 617,892

[22] Filed: Jun. 6, 1984

[51] Int. Cl.[3] ..... A63G 9/00

[52] U.S. Cl. ..... 272/85; 135/107; 135/DIG. 9; 248/166; 248/168; 403/102

[58] Field of Search ..... 272/85, 86, 87, 88, 272/89, 90, 91, 92, 61, 62, 113; 248/166, 168; 403/101, 102; 135/107, 109, DIG. 9

[56] References Cited

U.S. PATENT DOCUMENTS

| | | | |
|---|---|---|---|
| 131,696 | 9/1872 | Mathewson | 403/102 X |
| 812,344 | 2/1906 | Howser | 248/166 X |
| 1,719,440 | 7/1929 | Nathan | 248/166 X |
| 2,149,059 | 2/1939 | Leon | 403/102 X |
| 3,161,973 | 12/1964 | Hastings | 403/102 X |
| 3,483,999 | 12/1969 | Barrett | 248/168 X |

FOREIGN PATENT DOCUMENTS

| | | | |
|---|---|---|---|
| 181392 | 3/1955 | Austria | 248/166 |
| 1301588 | 7/1962 | France | 403/102 |

*Primary Examiner*—Robert A. Hafer
*Assistant Examiner*—Arnold W. Kramer
*Attorney, Agent, or Firm*—Cesari and McKenna

[57] ABSTRACT

A foldable swing set includes a crossbar whose opposite ends are supported by pairs of legs. Each pair of legs is secured to the associated end of the crossbar by a bracket which forms sockets sized to slidably receive the upper ends of the legs. Each leg is rotatably and slidably secured to its bracket socket enabling the leg to be swung perpendicular to the crossbar and telescopically received in that socket to help support the swing set in its erected position and to be withdrawn from that socket and swung parallel to the crossbar in order to fold the swing set into a compact package.

4 Claims, 3 Drawing Figures

FOLDABLE SWING SET

This invention relates to a swing set. It relates more particularly to a swing set designed particularly for adults which can be folded so that the swing can be transported and stored conveniently and compactly.

BACKGROUND OF THE INVENTION

Metal swing sets have been available for many years. Some such sets are made foldable to that they occupy a minimum amount of space when transported and stored. Usually, however, it is necessary to disconnect various threaded fasteners and bolts in order to detach and/or fold the various parts of the prior swing sets. Often, these fasteners become rusted and bent to that they can no longer be disengaged conveniently when it is desired to fold the set.

SUMMARY OF THE INVENTION

Accordingly, the present invention aims to provide an improved foldable swing set.

Another object of the invention is to provide an adult swing set which can be erected and taken down quite easily without any special tools.

A further object of the invention is to provide an improved frame for a swing set which have especially strong connections between the frame legs and the frame crossbar when the frame is erected, yet which permits the legs to be folded compactly against the crossbar when the frame is in its folded condition.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

The present swing is intended to seat at least two adults side by side and its seat is sized accordingly. To support this amount of weight, the swing set frame includes a rigid crossbar supported at its opposite ends by upstanding legs connected to the crossbar by special brackets. These brackets achieve very strong connections between the crossbar and legs, yet enable the legs to be folded between open or operating positions wherein the legs are spread apart and extend generally perpendicular to the crossbar and collapsed positions wherein the legs are nested against the crossbar. When the legs are in their open positions, they are anchored firmly to the crossbar by way of the end brackets so that the crossbar is firmly held horizontally above the ground enabling a relatively wide swing seat to be suspended by chains from the crossbar. A locking assembly is provided in each bracket for locking the legs in their open positions. When it is necessary to fold the swing set, that locking assembly can be released easily by hand to enable the legs to be swung to collapsed positions against the crossbar. If desired, the swing seat can also be disassembled so that the entire swing set can be stored in a minimum amount of space.

Each corner bracket comprises a sturdy length of tubing bent to an inverted U shape, with the opposite legs of the tubing forming sockets arranged to slidably receive the upper ends of the legs at one end of the swing set. A tubular sleeve buttwelded to the bridge of the U-shaped tube slidably receives the adjacent end of the crossbar. Appropriate fasteners permanently secure that tube to the crossbar. Each bracket socket has a pair of diametrically opposite end extensions or ears which lie generally parallel to the bracket sleeve. Each pair of ears is formed with aligned holes and the upper end portion of each leg that is received in a bracket socket is slotted lengthwise at diametrically opposite sides of the tube. These slots are aligned with the holes in the socket extensions so that a bolt can be passed through the socket holes and leg slots. A nut mounted in a larger knob is threaded onto the protruding end of the bolt.

Each leg is thus both slidably and pivotally connected to its bracket socket. When the legs are aligned with their sockets, their upper ends can be slid or telescoped into their sockets and the knobs tightened forming assemblies that retain the legs securely in position to support the frame crossbar above the ground. The swing seat can then be suspended from the crossbar by chains or ropes in the usual way.

When it is desired to store the swing set, the swing seat is detached from the crossbar and the two locking knobs at each bracket are loosened sufficiently to permit the associated legs to be withdrawn from their bracket sockets, the leg slots providing clearance for the locking bolts extending through the socket extensions or ears. As soon as the upper end of a leg clears its socket, that leg can be swung about its locking bolt so as to lie more or less parallel to the frame crossbar. When all four legs of the swing set are folded or collapsed thusly, the frame constitutes a long, relatively thin package which can be stored in a minimum amount of space. The folding and unfolding of the swing set as aforesaid can be accomplished quickly and easily and without any special tools since the locking bolts, as noted above, can be released by hand. Therefore, the swing set can be erected in a yard or on a porch quite easily when weather permits and yet can be taken down equally easily in inclement weather and when it is necessary to transport or store the swing set. Therefore, the present construction encourages the use of such swing sets by adults.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 1:
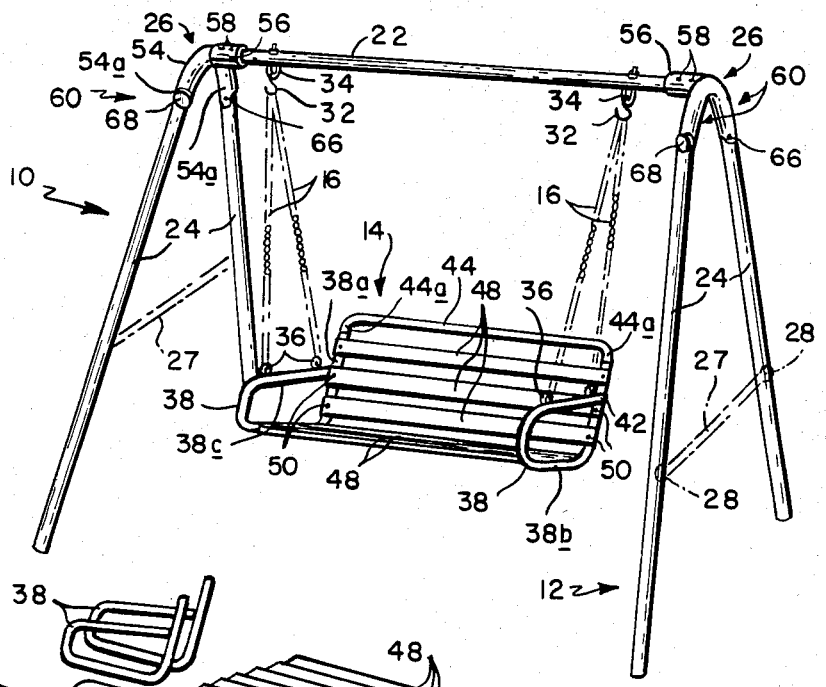
FIG. 1 is a perspective view of a foldable swing set embodying the principles of this invention with the swing set being shown in its erected condition.

Referring to the drawing FIG. 1, the present swing set comprises an upstanding frame shown generally at 12 and a relatively wide swing seat indicated generally at 14 which is suspended from the frame by lengths of chain 16 so that the seat can swing to and fro at a convenient height above the ground or other surface on which the frame rests.

Frame 12 comprises a horizontal tubular crossbar 22 whose opposite ends are supported by pairs of tubular legs 24. The upper ends of the two legs at each end of the swing set are connected to the adjacent end of crossbar 22 by corner brackets shown generally at 26. Each bracket 26 supports the associated pair of legs so that, when the swing set is in its erected condition shown in FIG. 1, the lower ends of the legs at each end of the swing set are spread apart to form an inverted V so that the crossbar 22 is held in a stable horizontal position above the ground.

Although it is not necessary, a brace 27 indicated in dotted lines in FIG. 1 may be positioned midway along the legs at each end of the swing set, with the opposite ends of the brace being connected to those legs by appropriate threaded fasteners 28 so as to form A-frames at the opposite ends of the set.

The two lengths of chain 16 supporting each end of seat 14 are connected at their upper ends to S-hooks 32 hooked through eye bolts 34 fastened to crossbar 22 just inboard of the adjacent bracket 26. The lower ends of the two chain lengths 16 at each end of the seat connect to eye bolts 36 bolted to a side frame member 38 of swing seat 14. Each member 38 has a generally vertical backrest segment 38*a* at the back of the swing seat and a generally horizontal seat segment 38*b* at the bottom of the swing seat. The forward end portion of segment 38*b* is turned back on itself to form an upwardly-rearwardly extending armrest segment 38*c*, the free end of which is connected by an appropriate threaded fastener 42 to the vertical backrest segment 38*a*. The chain-supported eyebolts 36 at each end of seat 14 are connected at spaced-apart locations to seat frame segment 38*c*.

The upper ends of the side frame backrest segments 38*a* telescope into the opposite downturned ends 44*a* of a generally horizontal, tubular backrest frame member 44 which helps to maintain the two side frame members 38 in spaced relation. Also, helping in this respect are a series of slats 48 formed by flattened metal tubes. The opposite ends of these tubes are secured to the backrest and seat segments of side frame members 38 by appropriate threaded fasteners 50. With the frame 12 in its erected position shown in FIG. 1, the upper ends of the chain lengths 16 are adjusted on their hooks 32 so that the seat 14 is suspended in a substantially horizontal position below crossbar 22.

Figure 3:
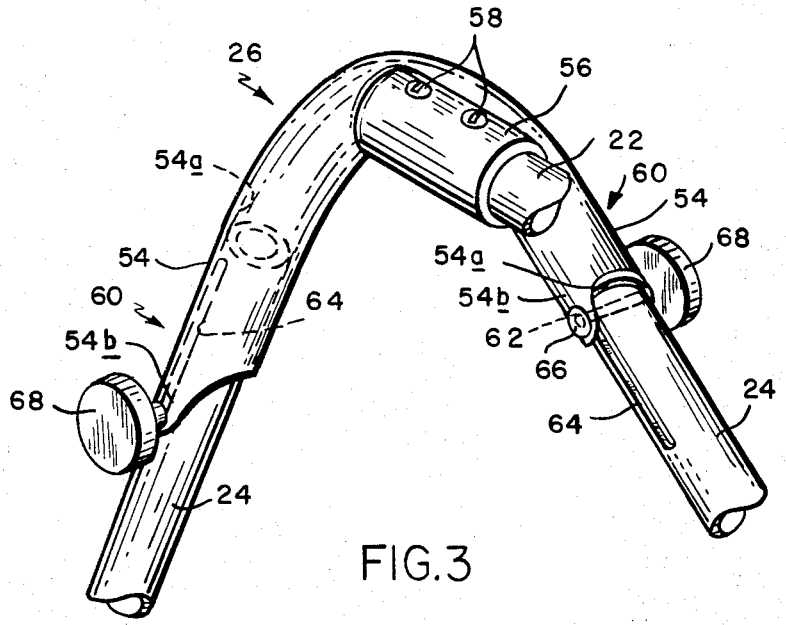
FIG. 3 is a fragmentary perspective view on a larger scale showing a portion of the FIG. 1 gym set in greater detail.

Referring now to FIG. 3, each bracket 26 comprises a length of metal tubing 54 which is bent to form an inverted letter V or U, with the opposite ends of that tube forming sockets 54*a*, sized to slidably receive the upper end segments of legs 24. A relatively short tubular sleeve 56 buttwelded to the bridging portion of tubing 54 slidably engages over the corresponding end portion of crossbar 22. Appropriate bolts or threaded fasteners 58 extend through registering holes in the walls of sleeve 56 and crossbar 22 to firmly anchor each bracket 26 to the crossbar, with the sockets 54*a* of both brackets being aligned.

Each bracket includes a pair of leg locking assemblies shown generally at 60. Each such assembly comprises a pair of diametrically opposite ears 54*b* extend beyond the free end of each socket 54*a* for a distance somewhat greater than the radius of legs 24. Furthermore, each pair of ears is formed with aligned bolt holes 62. The ears of each pair lie generally parallel to each other and perpendicular to crossbar 22 so that their holes 62 define a line that is spaced from and extends substantially perpendicular to the longitudinal axis of the crossbar. Also, a pair of longitudinal slots 64 are present in the opposite walls of each leg 24 and adjacent to its upper end. Each leg 24 is positioned so that its slots 64 are in register with the ear holes 62 permitting a headed bolt 66 to extend through the registering holes and slots, with the threaded end of the bolt being located at an accessible location on the outboard side of the bracket 54. A relatively large knob 68 containing an internal nut (not shown) is then threaded onto the exposed end of bolt 66.

Figure 2:
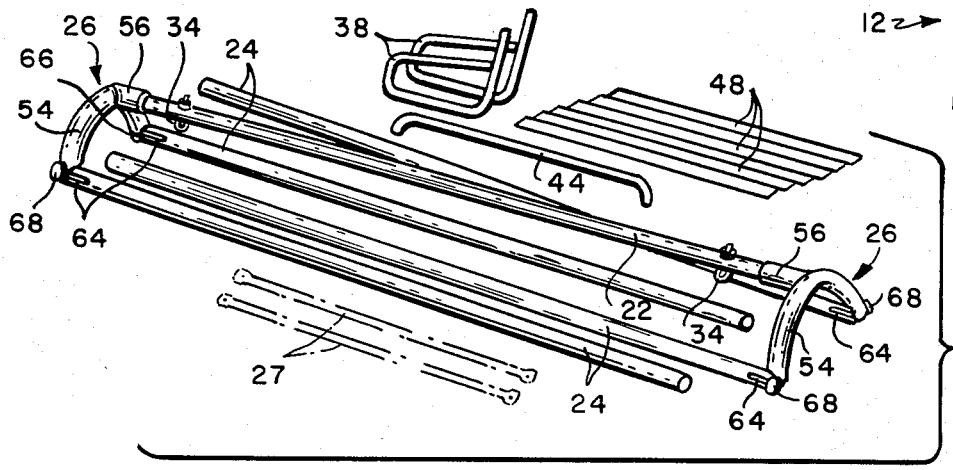
FIG. 2 is a similar view of the set shown in its folded condition.

When the associated knob 68 is loose on its bolt 66 and the corresponding leg 24 is aligned axially with its socket 54*a*, that leg can be shifted axially from a position wherein it is telescopically received within its socket 54*a*, as shown at the left side of FIG. 3 to a position wherein the end of that leg is withdrawn from and clears the end of the socket, as shown at the right side of FIG. 3, the leg slots 64 provided clearance for the associated bolt 66. In the former position wherein the leg is snugly received in its socket, there is very little relative movement between the leg 24 and its bracket 26. If now the knob 68 is turned tightly down on its bolt 66, the leg and bracket are tightly locked together. When the leg 24 is in its latter withdrawn position, it can be swung about its locating bolt 66 to a folded or collapsed position wherein the leg lies substantially parallel to the crossbar 22 as shown in FIG. 2. If all of the legs 24 are folded as aforesaid, the frame 12 occupies a relatively small space. Thus the entire swing set including its frame 12 and seat 14 can be stored conveniently in a closet or the like. Although it is usually not necessary, even further space savings can be achieved by disassembling seat 14 into its individual components as shown in FIG. 2. Usually, however, this is not necessary because the seat is already quite compact so that it can be stored in the same space as the frame 12.

It will be seen from the foregoing, then, that the present swing set permits the frame which supports the swing seat to be erected and folded quite easily without requiring any tools. This is particularly so because the brackets 26 and locking assemblies 60 which releasably connect the legs to the frame crossbar are not prone to jamming because of rusting or bending of the frame components. Therefore, the swing set should have a long useful life even though it is exposed to the elements.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawing be interpreted as illustrative and not in a limiting sense.

It is also to be understood that the following claims ae intended to cover all of the generic and specific features of the invention herein described.

What is claimed as new and desired to be secured by Letters Patent of the United States is:

1. In a foldable swing set of the type including a support frame composed of a crossbar, a pair of suport legs connected to each of the opposite ends of the crossbar, a swing seat and means for suspending the seat from the crossbar, the improvement wherein the connection of each pair of legs to the crossbar comprises A. a bracket composed of a substantially inverted U-shaped tubular member defining a pair of sockets at its opposite ends sized to slidably receive upper end portions of the associated pair of legs;

B. means for attaching said tubular member between its ends to the corresponding end of the crossbar;

C. a pair of diametrically opposite ears extending beyond each end of said tubular member on the opposite sides of the associated leg for a distance that is no less than the radius of said leg;

D. a pair of aligned holes in each pair of ears, the line between each said pair of holes being spaced from and substantially perpendicular to the longitudinal axis of said crossbar;

E. a pair of diametrically opposite longitudinal slots in each said leg upper end portion, said slots being aligned with said ear openings; and F. fastener means extending through said ear holes and slots at each bracket socket so as to slidably and rotatively connect each leg to its socket whereby each leg can be moved between a first position in which the upper end portion of said leg is telescopically received in the associated socket with the leg lying generally perpendicular to the crossbar and a second position wherein said leg portion is withdrawn from its said socket with the leg lying generally parallel to the crossbar.

2. In a foldable swing set of the type including a support frame composed of a crossbar, a pair of support legs connected to each of the opposite ends of the crossbar, a swing seat and means for suspending the seat from the crossbar, the improvement wherein the connection of each pair of legs to the crossbar comprises A. a bracket composed of a substantially inverted U-shaped tubular member defining a pair of sockets at its opposite ends sized to slidably receive upper end portions of the associated pair of legs;

B. means for attaching said tubular member between its ends to the corresponding end of the crossbar;

C. a pair of diametrically opposite ears extending beyond each end of said tubular member on the opposite sides of the associated leg for a distance that is no less than the radius of said leg;

D. a pair of aligned holes in each pair of ears, the line between each said pair of holes being spaced from and substantially perpendicular to the longitudinal axis of said crossbar;

E. a pair of diametrically opposite longitudinal slots in each said leg upper end portion, said slots being aligned with said ear openings; and F. fastener means extending through said ear holes and slots at each bracket socket so as to slidably and rotatively connect each leg to its socket whereby each leg can be moved between a first position in which the upper end portion of said leg is telescopically received in the associated socket with the leg lying generally perpendicular to the crossbar and a second position wherein said leg portion is withdrawn from its said socket with the leg lying generally parallel to the crossbar; and further including means for releasably retaining each leg in its said first position.

3. The swing set defined in claim 2 wherein

A. the fastener means comprise a bolt; and

B. the retaining means comprise a threaded knob turned onto the threaded end of the bolt.

4. The swing set defined in claim 1 wherein the attaching means comprise A. a tubular sleeve buttwelded to said tubular member and sized to telescopically receive the associated end of the crossbar; and B. fastening means for securing the sleeve to the crossbar end.

* * * * *